US008216991B2

(12) United States Patent
Barnabas et al.

(10) Patent No.: US 8,216,991 B2
(45) Date of Patent: Jul. 10, 2012

(54) SOLVENT SYSTEM FOR MICROEMULSION OR PROTOMICROEMULSION AND COMPOSITIONS USING THE SOLVENT SYSTEM

(75) Inventors: Freddy Arthur Barnabas, West Chester, OH (US); Jennifer Lynn Treadway, Taylor Mill, KY (US)

(73) Assignee: The Procter & Gamble company, Cincinnati, OH (US)

( * ) Notice: Subject to any disclaimer, the term of this patent is extended or adjusted under 35 U.S.C. 154(b) by 460 days.

(21) Appl. No.: 12/499,987

(22) Filed: Jul. 9, 2009

(65) Prior Publication Data

US 2010/0009890 A1 Jan. 14, 2010

Related U.S. Application Data

(60) Provisional application No. 61/080,458, filed on Jul. 14, 2008.

(51) Int. Cl.
*C11D 3/44* (2006.01)
*C11D 1/94* (2006.01)

(52) U.S. Cl. ..... 510/237; 510/235; 510/242; 510/251; 510/417; 510/422; 510/432

(58) Field of Classification Search ..... 510/235, 510/237, 242, 251, 417, 422, 432
See application file for complete search history.

(56) References Cited

U.S. PATENT DOCUMENTS

| | | | | |
|---|---|---|---|---|
| 5,980,921 | A * | 11/1999 | Biedermann et al. | 424/401 |
| 6,008,181 | A | 12/1999 | Cripe et al. | |
| 6,020,303 | A | 2/2000 | Cripe et al. | |
| 6,060,443 | A | 5/2000 | Cripe et al. | |
| 6,123,932 | A * | 9/2000 | Guskey et al. | 424/65 |
| 6,139,827 | A * | 10/2000 | Cohen et al. | 424/70.16 |
| 7,402,301 | B2 * | 7/2008 | Candau | 424/59 |
| 2002/0061319 | A1 * | 5/2002 | Bernard et al. | 424/401 |
| 2003/0105169 | A1 * | 6/2003 | Lennon | 516/53 |
| 2004/0229763 | A1 | 11/2004 | Hutton et al. | |
| 2004/0229963 | A1 | 11/2004 | Stephane et al. | |
| 2004/0254253 | A1 | 12/2004 | Culeron et al. | |
| 2005/0209123 | A1 * | 9/2005 | Laux | 510/407 |

FOREIGN PATENT DOCUMENTS

| | | | |
|---|---|---|---|
| EP | 0 316 726 | A2 | 9/1988 |
| GB | 2 190 681 | A | 11/1987 |
| WO | WO 96/26262 | A1 | 8/1996 |
| WO | WO 96/01305 | A1 | 11/1996 |
| WO | WO 99/05244 | A1 | 2/1999 |

* cited by examiner

*Primary Examiner* — Charles Boyer
(74) *Attorney, Agent, or Firm* — John T. Dipre; David V. Upite

(57) ABSTRACT

A solvent system for use in a microemulsion or protomicroemulsion where the solvents are selected to have a Hansen parameter of δd to be from 15 to about 18; of δp to be from 0 to about 8 and of δH to be from 0 to about 12; such that the resulting Hansen parameter of the solvents comprises has a δd of from 15 to about 18; a δp from about 2 to about 8 and a δH of from about 5 to about 12.

9 Claims, No Drawings

SOLVENT SYSTEM FOR MICROEMULSION OR PROTOMICROEMULSION AND COMPOSITIONS USING THE SOLVENT SYSTEM

CROSS REFERENCE TO RELATED APPLICATION

This application claims the benefit of priority to U.S. Provisional Application Ser. No. 61/080,458, filed Jul. 14, 2008 which is herein incorporated by reference.

FIELD OF THE INVENTION

The present invention relates to the use of a specified solvent system in a microemulsion or protomicroemulsion cleaning composition for improved properties.

BACKGROUND OF THE INVENTION

Cleaning compositions for hard surfaces such as floors, windows, dishes, kitchen surfaces, etc. are highly dependent upon the speed of cleaning undesired deposits from the hard surfaces such a grease soils. Microemulsions or protomicroemulsions are known for good grease cleaning, but not known for having good foam profile or foam longevity.

Examples of microemulsion compositions for cleaning hard surfaces include WO9626262, WO9601305, GB 2190681, and EP 316726. Examples of microemulsion or protomicroemulsions used with a foam-generating dispenser include US 2004/0254253 A1, US 2004/0229763A1 and US 2004/0229963A1.

When cleaning compositions are used in direct contact cleaning situations (as opposed to submersion of a hard surface in a diluted cleaning composition) the speed of cleaning or the cleaning kinetics is very important. Any improvement the cleaning kinetics for undesired deposits on hard surfaces, such a grease soils is desired. Therefore there exists a need to improve the speed of the grease cleaning of microemulsion compositions without increasing the cost or complexity of such compositions.

Solvent selection is one aspect that can be optimized to achieve the desired speed of grease cleaning. However, limitations on solvents such as volatility, safety and smell often limit the potential selections of solvents. For example, use of a solvent such a terpineol meets the required volatility and safety requirements, as well as cleaning performance, but gives a very strong pine smell which is unacceptable to some users.

Therefore, there exists a desire to select suitable solvent systems for microemulsion or protomicroemulsion compositions that give the desired speed of grease cleaning, volatility, safety and smell profiles.

It is further desired to deliver such a composition having good foam profile or foam longevity.

SUMMARY OF THE INVENTION

The present application relates to a solvent system for use in a microemulsion or protomicroemulsion composition selected from the group comprising: decanedioic acid dimethyl ester; diisopropyladipate; diisobutyl adipate; a permethyl comprising:

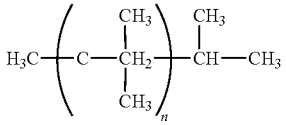

wherein n is from 3 to 5;

dipropylene glycol methyl ether, propylene glycol monopropyl ether, 1-Phenoxy-2-propanol and mixtures thereof.

The present application further relates to a solvent system for use in a microemulsion or protomicroemulsion composition comprising: one or more solvents, the one or more solvents comprising a Hansen parameter comprises a δd of from 15 to about 18; δp from 0 to about 8 and δH of from 0 to about 12; wherein the resulting Hansen parameter of the one or more solvents comprises a δd of from 15 to about 18; δp from about 2 to about 8 and δH of from about 5 to about 12.

DETAILED DESCRIPTION OF THE INVENTION

All percentages, ratios and proportions herein are by weight of the final high surfactant composition, unless otherwise specified. All temperatures are in degrees Celsius (° C.) unless otherwise specified.

As used herein, the term "comprising" means that other steps, ingredients, elements, etc. which do not affect the end result can be added. This term encompasses the terms "consisting of"and "consisting essentially of".

As used herein, the term "dish" means any dishware, tableware, cookware, glassware, cutlery, cutting board, food preparation equipment, etc. which is washed prior to or after contacting food, being used in a food preparation process and/or in the serving of food.

As used herein, the terms "foam" and "suds" are used interchangeably and indicate discrete bubbles of gas bounded by and suspended in a liquid phase.

Foam profile or foam longevity as used herein refers to the change, or lack thereof, in the volume of foam generated from the method described below.

As used herein, the term "microemulsion" means an oil-in-water emulsion which has the ability to emulsify oil into non-visible droplets. Such non-visible droplets typically have maximum diameter of less than about 100 angstroms (Å), preferably less than 50 Å as measured by methods known in the art, such as ISO 7027 which measures turbidity at a wavelength of 880 nm. Turbidity measuring equipment is easily available from, for example, Omega Engineering, Inc., Stamford, Conn., U.S.A.

As used herein, the term "protomicroemulsion" means a composition which may be diluted with water to form a microemulsion.

Solvent System

The solvents for the use herein have Hansen parameters (δp-Polar, δd-Dispersion, δH-Hydrogen bonding) as discussed below. Additionally, solvent selection should also reflect limitations on solvents such as volatility, safety and smell often limit the potential selections. The solvents cannot be volatile such that it will evaporate a standard pressure and room temperature (25° C.). The solvents cannot pose a safety hazard to the health of anyone coming into contact with the solvent. Lastly, some solvents, while effective, have an objectionable odor to users. Such solvents should also be avoided.

The Hansen parameters may be derived from a single solvent or a mixture of solvents. Any single solvent may have the Hansen parameters of δd (Dispersion) from about 15-18; δp (Polar) from 0 to about 10; δH (Hydrogen bonding) from 0 to about 12.

If a mixture of solvents is utilized, the molar fractions should result in a Hansen parameters of δd (Dispersion) from about 15-18 δp (Polar) from about 2 to about 8 δH (Hydrogen bonding) from about 5 to about 12.

Solvents which may be used can be selected from: decanedioic acid dimethyl ester (d=16.6; p=2.9; H=6.7); diisopropyladipate (Estimated d=16.9; p=2.5; H=6.3); diisobutyl adipate (d=16.7; p=2.5; H=6.3); Combination of a permethyl comprising:

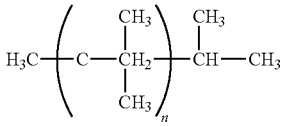

wherein n is from 3 to 5;

and one or more of (1) dipropylene glycol methyl ether, (2) propylene glycol monopropyl ether or (3) 1-Phenoxy-2-propanol.

In one embodiment, a solvent system comprises a combination of a permethyl wherein n is from 3 to 5 and 1-Phenoxy-2-propanol in a 1:3 to 3:1 ratio.

In one embodiment, a microemulsion or protomicroemulsioin composition comprises from about 3 wt % to about 6 wt % of permethyl wherein n is from 3 to 5; and from about 3 wt % to about 6 wt % 1-Phenoxy-2-propanol wherein the total weight percent of the permethyl and 1-Phenoxy-2-propanol is about 9 wt % by weight of the composition.

Optional Low Water-Soluble Compounds

The optional low water-soluble compound is typically present at a level of from about 0.1% to about 50%, preferably from about 0.3% to about 40%, and more preferably from about 0.4% to about 35%, and even more preferably from about 0.5% to about 10%, by weight of the composition. The low water-soluble compound herein has a solubility in water of from about 5% to about 0.1% (50,000 ppm to 1000 ppm) by weight of the solution.

The low water-soluble compound is selected from the group consisting of a carbitol, $C_{2-6}$ alkyl glycol ether, aryl $C_{2-6}$ alkyl glycol ether, and a mixture thereof having the solubility described above. The low water-soluble compound selected from $C_{2-6}$ alkyl glycol ether include ethylene glycol monobutyl ether(butyl cellosolve); diethylene glycol monobutyl ether(butyl carbitol); triethylene glycol monobutyl ether; mono-, di-, tripropylene glycol monobutyl ether; tetraethylene glycol monobutyl ether, mono-, di-, tripropylene glycol monomethyl ether; propylene glycol monomethyl ether; ethylene glycol monohexyl ether; diethylene glycol monohexyl ether; propylene glycol tertiary butyl ether; ethylene glycol monoethyl ether; ethylene glycol monomethyl ether; ethylene glycol monopropyl ether; ethylene glycol monopentyl ether; diethylene glycol monomethyl ether; diethylene glycol monoethyl ether; diethylene glycol monopropyl ether; diethylene glycol monopentyl ether; triethylene glycol monomethyl ether; triethylene glycol monethyl ether; triethylene glycol monopropyl ether; triethylene glycol monopentyl ether; triethylene glycol monohexyl ether; mono-, di-, tripropylene glycol monoethyl ether; mono-, di-, tripropylene glycol monopropyl ether; mono-, di-, tripropylene glycol monopentyl ether; mono-, di-, tripropylene glycol monohexyl ether; mono-, di-, tributylene glycol monomethyl ether; mono-, di-, tributylene glycol monoethyl ether; mono-, di-, tributylene glycol monopropyl ether; mono-, di-, tributylene glycol monobutyl ether; mono-, di-, tributylene glycol monopentyl ether and mono-, di-, tributylene glycol monohexyl ether. Preferred glycol ether microemulsion-forming surfactants include diethylene glycol monobutyl ether(butyl carbitol) and dipropylene glycol monomethyl ether (DOWANOL® DPM).

The optional low water-soluble compound may be a traditional oil or may be a microemulsion forming solvent. Preferred oils are either: a) cyclic hydrocarbons having 6-15 carbon atoms, or, b) ethers of 2-6 carbon alcohols wherein the total carbon number of the molecule is $C_{6-10}$, or, C) monoesters of 2-6 carbon fatty acids with 2-6 carbon alcohols wherein the total carbon number of the molecule is $C_{6-10}$. Also included are perfumes or essential oils, referring to and include any non-water soluble fragrant substance or mixture of substances including natural (i.e., obtained by extraction of flower, herb, blossom or plant), artificial (i. e., a mixture of natural oils or oil constituents) and synthetic (i.e., a single or mixture of synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from about 0% to about 80%, usually from about 10% to 70% by weight, the essential oils themselves being volatile odoriferous compounds and also serving to dissolve the other components of the perfume.

Optional Water-Soluble Compounds

The optional water-soluble compounds will generally be present in the compositions herein to the extent from about 2% to about 10%. More preferably, the optional water-soluble compounds will comprise from about 3% to 7% of the compositions herein.

The optional water-soluble compounds useful herein is typically selected from the group consisting of alcohols, glycerine, glycols, and a mixture thereof, even more preferably the group consisting of ethanol, propylene carbonate, propylene glycol, glycerine, and a mixture thereof. The optional water-soluble compounds herein preferably has solubility in water of at least about 12%, more preferably of at least about 50%, by weight of the solution.

Glycerol when present as a water-soluble compound is present at a ratio of from about 1:1 to about 1:35 with the surfactant system, preferably in a ratio of from about 1:2 to about 1:20, more preferably from about 1:3 to about 1:15, even more preferably from about 1:3 to about 1:10.

A cleaning composition containing the solvent system described herein may further comprise one or more surfactants selected from anionic, nonionic and ampholytic. The surfactant system may further comprise a disrupting surfactant which contains a cationic charge.

Anionic Surfactants $C_{10-14}$ Alkyl or Hydroxyalkyl Sulphate or Sulphonate

A $C_{10-14}$ alkyl or hydroxyalkyl sulphate or sulphonate surfactant may be present at a level of at least 10%, more preferably from 20% to 40% and most preferably from 20% to 30% by weight of the liquid detergent composition.

Suitable $C_{10-14}$ alkyl or hydroxyalkyl sulphate or sulphonate surfactants for use in the compositions herein include water-soluble salts or acids of $C_{10}$-$C_{14}$ alkyl or hydroxyalkyl, sulphate or sulphonates. Suitable counterions include hydrogen, alkali metal cation or ammonium or substituted ammonium, but preferably sodium.

The alkyl or hydroxyalkyl sulphate or sulphonate surfactants may be selected from $C_{11}$-$C_{18}$ alkyl benzene sulfonates (LAS), $C_{10}$-$C_{20}$ primary, random alkyl sulfates (AS); $C_{10}$-$C_{18}$ secondary (2,3) alkyl sulfates; $C_{10}$-$C_{18}$ alkyl alkoxy sulfates ($AE_xS$) wherein preferably x is from 1-30; $C_{10}$-$C_{18}$ alkyl alkoxy carboxylates preferably comprising 1-5 ethoxy units; methyl ester sulfonate (MES); and alpha-olefin sulfonate (AOS).

Nonionic Surfactants

Optionally the nonionic surfactant, when present in the composition, is present in an effective amount, more preferably from 0.1% to 20%, even more preferably 0.1% to 15%, even more preferably still from 0.5% to 10%,by weight of the liquid detergent composition.

Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 20 carbon atoms with from 2 to 18 moles of ethylene oxide per mole of alcohol. Also suitable are alkylpolyglycosides having the formula $R^2O(C_nH_{2n}O)_t(\text{glycosyl})_x$ (formula (I)), wherein $R^2$ of formula (I) is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n of formula (I) is 2 or 3, preferably 2; t of formula (I) is from 0 to 10, preferably 0; and x of formula (I) is from 1.3 to 10, preferably from 1.3 to 3, most preferably from 1.3 to 2.7. The glycosyl is preferably derived from glucose. To prepare these compounds, the alcohol or alkylpolyethoy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Also suitable are fatty acid amide surfactants having the formula (II):

$$R^6\overset{\overset{\displaystyle O}{\|}}{C}N(R^7)_2 \qquad \text{(II)}$$

wherein $R^6$ of formula (II) is an alkyl group containing from 7 to 21, preferably from 9 to 17, carbon atoms and each $R^7$ of formula (II) is selected from the group consisting of hydrogen, $C_1$-$C_4$ alkyl, $C_1$-$C_4$ hydroxyalkyl, and $—(C_2H_4O)_xH$ where x of formula (II) varies from 1 to 3. Preferred amides are $C_8$-$C_{20}$ ammonia amides, monoethanolamides, diethanolamides, and isopropanolamides.

Ampholytic Surfactants

Ampholytic surfactants may include amine oxides containing one linear $C_{8-18}$ alkyl moiety and 2 moieties selected from the group consisting of $C_{1-3}$ alkyl groups and $C_{1-3}$ hydroxyalkyl groups; water-soluble phosphine oxides containing one linear $C_{10-18}$ alkyl moiety and 2 moieties selected from the group consisting of $C_{1-3}$ alkyl groups and $C_{1-3}$ hydroxyalkyl groups; and water-soluble sulfoxides containing one linear $C_{10-18}$ alkyl moiety and a moiety selected from the group consisting of $C_{1-3}$ alkyl and $C_{1-3}$ hydroxyalkyl moieties.

Preferred amine oxide surfactants have formula (III):

$$R^3(OR^4)_x\overset{\overset{\displaystyle O}{\uparrow}}{N}(R^5)_2 \qquad \text{(III)}$$

wherein $R^3$ of formula (III) is a linear $C_{8-22}$ alkyl, linear $C_{8-22}$ hydroxyalkyl, $C_{8-22}$ alkyl phenyl group, and mixtures thereof; $R^4$ of formula (III) is an $C_{2-3}$ alkylene or $C_{2-3}$ hydroxyalkylene group or mixtures thereof; x is from 0 to about 3; and each $R^5$ of formula (III) is an $C_{1-3}$ alkyl or $C_{1-3}$ hydroxyalkyl group or a polyethylene oxide group containing an average of from about 1 to about 3 ethylene oxide groups. The $R^5$ groups of formula (III) may be attached to each other, e.g., through an oxygen or nitrogen atom, to form a ring structure.

These amine oxide surfactants in particular include $C_{10}$-$C_{18}$ alkyl dimethyl amine oxides and $C_8$-$C_{12}$ alkoxy ethyl dihydroxy ethyl amine oxides. Preferred amine oxides include $C_{10}$, $C_{10}$-$C_{12}$, and $C_{12}$-$C_{14}$ alkyl dimethyl amine oxides.

When present, at least one amine oxide will be present in the liquid detergent composition from about 0.1% to about 15%, more preferably at least about 0.2% to about 12% by weight of the composition. In one embodiment, the amine oxide is present in the liquid detergent composition from about 5% to about 12% by weight of the composition. In another embodiment, the amine oxide is present in the liquid detergent composition from about 3% to about 8% by weight of the composition.

Other suitable, non-limiting examples of amphoteric detergent surfactants that are optional in the present invention include amido propyl betaines and derivatives of aliphatic or heterocyclic secondary and ternary amines in which the aliphatic moiety can be straight chain or branched and wherein one of the aliphatic substituents contains from 8 to 24 carbon atoms and at least one aliphatic substituent contains an anionic water-solubilizing group.

Typically, when present, ampholytic surfactants comprise from about 0.01% to about 20%, preferably from about 0.5% to about 10% by weight of the liquid detergent composition.

Disrupting Surfactant

The purpose of the disrupting co-surfactant is to provide a disrupting structure that can participate in the micelle structure of the one or more surfactants. A selected structure for the disrupting surfactant is believed to loosen the packing structure and allow for the increased movement of the one or more surfactant. This increased movement is believed to correspond to increased speed of grease cleaning from hard surfaces. Disrupting co-surfactant a hydrophobic tail and a head group, wherein the disrupting surfactant is different from the one or more surfactants.

The disrupting surfactant in one embodiment is selected as comprising a cationic charge in the head group and two hydrophobic tails. In another embodiment, the disrupting surfactant is selected as comprising a cationic charge in the head group and two hydrophobic tails, wherein at least one of the hydrophobic tails is branched.

The disrupting surfactant in one embodiment is selected as comprising:

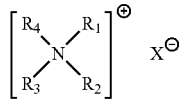

(IV)

wherein $R_1$ and $R_2$ of formula (IV) are individually selected from the group consisting of $C_1$-$C_4$ linear alkyl moieties; X of formula (IV) is a water soluble anion; and (1) $R_3$ and $R_4$ of formula (IV) are each a $C_6$-$C_{14}$ alkyl moiety. A preferred asymmetric quaternary compounds for this invention are compounds where $R_3$ and $R_4$ of formula (IV) are not identical, and preferably one is branched and the other one is linear.

An embodiment of a symmetric quaternary compound is UNIQUAT 2250 where X of formula (IV) is a carbonate and bicarbonate, $R_1$ and $R_2$ of formula (IV) are methyl groups, $R_3$ and $R_4$ of formula (IV) are $C_{10}$ alkyl groups. UNIQUAT 2250 is a registered trademark of Lonza and in North America is available thru Lonza Incorporated of Allendale, N.J.

An embodiment of a asymmetric quaternary compound is ARQUAD HTL8-MS where X is a methyl sulfate ion, $R_1$ and $R_2$ of formula (IV) are methyl groups, $R_3$ of formula (IV) is a hydrogenated tallow group with <5% mono unsaturation, and $R_4$ of formula (IV) is a 2-ethylhexyl group. ARQUAD HTL8-MS is available from Akzo Nobel Chemical of Arnhem, Netherlands.

The disrupting surfactant in one embodiment is selected as comprising:

(V)

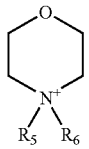

Wherein $R_5$ of formula (V) is selected from a $C_{12}$-$C_{18}$ linear alkyl moiety and $R_6$ of formula (V) is selected from a $C_1$-$C_4$ linear alkyl moiety.

A suitable embodiment of this structure is BARQUAT CME-35 available from Lonza and having the following structure:

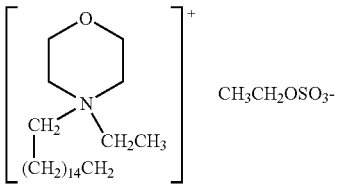

Test Methods

The oil solubilization herein is measured both for the speed of absorption as well as the solubilization capacity. To measure the solubilization capacity, 10.0 g of product (this amount includes water, if testing at a specific dilution) to be tested is placed in a 25 mL scintillation vial. For example, testing done on an 85% strength solution would contain 8.50 g of product and 1.50 g of water. To this, 0.1 g food grade vegetable oil dyed with 0.045% of Pylakrome RED-LX1903 (a mixture of SOLVENT RED 24 CAS#85-83-6 and SOLVENT RED 26 CAS#4477-79-6, available from Pylam Products, Tempe, Ariz., U.S.A.) dye is added, and the vial capped. Testing is done at room temperature (20° C.). Using a vortex machine, such as a Vortex Genie 2 on setting #8, the vial agitated for 30 seconds. The sample should then be sonicated in a Sonicator Branson 2210, for 10 seconds or until there is at least ⅛$^{th}$ inch of liquid (rather than foam). The sample is then allowed to stand until it becomes clear and the time in seconds is recorded. As used herein, "clear" means that when a line of Times New Roman text 1/16 inch (6 pt)-⅛ inch (10 pt) tall can be read through the sample liquid, the sample is "clear".

If the vial becomes clear, then more oil is added, in increments of 0.1 g, until the vial fails to become clear within 240 seconds. The % oil dissolution is recorded as the maximum amount of oil which was successfully solubilized (i.e., the vial is clear) by 10.0 g of product To measure the speed of absorption, the above test is conducted, except that for a given 10.0 g of product, the time required (as measured at rest) for 0.1 g (i.e., 1%) of dyed vegetable oil to be solubilized is recorded. Preferably the invention herein solubilizes 2% of dyed canola oil within about 15 minutes, more preferably within about 5 minutes, and even more preferably within about 60 seconds, when tested at a 75% product concentration.

Foam Profile: Foam Longevity

Fill a container having a foam-generating dispensers attached, such as WR-F3 series foamers from Airspray International, Inc., with the product. The product is dispensed from the container via the foam-generating dispenser at a constant pressure of 60 psi and a constant rate of 0.5 seconds.

The footprint area of the resulting foam in measured and the volume is approximated by measuring the height of the resulting foam. After waiting 2 minutes the measurements are repeated. The change in volume of the foam should be less than 50%, preferably less than 40% of the original volume.

TABLE 1

| 1-Phenoxy-2-propanol wt % | 0 | 1 | 2 | 3 | 4 | 5 | 6 | 7 | 8 | 9 |
|---|---|---|---|---|---|---|---|---|---|---|
| Permethyl wt % | 9 | 8 | 7 | 6 | 5 | 4 | 3 | 2 | 1 | 0 |
| GAT 100 | 0 | 2.5 | 3 | 3.2 | 3 | 2.6 | 2.0 | 1.5 | 1.5 | 1.5 |
| GAT 85 | 0 | 0 | 1 | 2.7 | 3.3 | 3.1 | 2.5 | 1.5 | 1 | 1 |

Table 1 above shown the oil solubilization (GAT) at a 100% strength solution and at an 85% strength solution for a combination of 1-Phenoxy-2-propanol and permethyl wherein the total number of carbons is 20 (formulation above wherein n is 4) and how the combination together demonstrates and unexpected synergy.

Table 2 below shows some exemplified embodiments of the cleaning composition.

TABLE 2

| | A Wt % | B Wt % | C Wt % | D Wt % | E Wt % | F Wt % |
|---|---|---|---|---|---|---|
| Sodium $C_{12}$ Alkyl Ethoxy$_{0.6}$ Sulfate | 28 | 41.2 | 49.40 | 41.2 | 41.2 | 41.2 |
| $C_{12-14}$ Alkyl Dimethyl Amine Oxide | 6.0 | 9.75 | 11.70 | 9.75 | 9.75 | 9.75 |
| $C_{8-11}$ Alcohol Ethoxylated Nonionic surfactant | 2.0 | — | — | — | — | — |
| Disrupting Surfactant[1] | — | 2.0-3.0 | 2.0-3.6 | 2.0-3.0 | 2.0-3.0 | 2.0-3.0 |
| 1,3-bis (methylamine)-cyclohexane | 0.32 | 0.15 | 0.18 | 0.15 | 0.15 | 0.15 |

TABLE 2-continued

| | A Wt % | B Wt % | C Wt % | D Wt % | E Wt % | F Wt % |
|---|---|---|---|---|---|---|
| (N,N-dimethylamino)ethyl methacrylate homopolymer | — | 0.11 | 0.11 | 0.11 | 0.11 | 0.11 |
| Organic | | | | | | |
| Terpineol | 0.5 | — | — | — | — | — |
| DOWANOL ® Propylene Glycol Phenyl Ether | 8.0 | 6.5 | 6.5 | 3.5-4.5 | 4.0-6.0 | 3.0-6.5 |
| Permethyl[2] | — | 2.5 | 2.5 | 2.0-3.0 | 2.5-4.0 | 1.5-6.0 |
| Solvent | | | | | | |
| Ethanol | 7.8 | 7.0 | 7.0 | 7.0 | 7.0 | 7.0 |
| Glycerol | 4.0 | 0 | 8.0 | 4.0 | 4.0 | 4.0 |
| Propylene Glycol | 0 | 2.0 | 2.0 | 2.0 | 2.0 | 2.0 |
| Other | | | | | | |
| Sodium Cumene Sulfonate | 3.0 | 1.0 | 3.0 | 1.0 | 1.0 | 1.0 |
| NaCl | 1.4 | 0.7 | 0.7 | 0.7 | 0.7 | 0.7 |
| Perfume | 0.2 | 0.6 | 0.6 | 0.6 | 0.5 | 0.6 |
| Water | bal. | bal. | bal. | bal. | bal. | bal. |

[1]The disrupting surfactant may be any of those discussed in detail above.
[2]The permethyl may be selected from any discussed in detail above.

Formula A is a comparative formulation without the required solvent system in the composition.

Method of Use

The composition herein is particularly suited for use as a cleaning composition, more preferably as a dishwashing composition, and even more preferably as a hand dishwashing composition. The invention herein is especially useful in the direct-application context where the protomicroemulsion is applied to a substrate such as a sponge, a wiping substrate, a scrubbing substrate, a nonwovern material, etc. Water is usually then added to the substrate to dilute the protomicroemulsion to form a microemulsion in situ, preferably in or on the substrate itself, although the microemulsion may also be formed in, for example, a sink or wash basin. The microemulsion is then applied directly or indirectly to a surface to be cleaned, such as a dish, a glass, flatware, etc., and preferably soaked for from about 2 seconds to about 1 hour. The surface is rinsed to remove the dirt, soil, and microemulsion and then preferably, dried. Such a method effectively cleans not only dishes, glasses, and flatware, but may also clean kitchen countertops, tile, bathrooms, hardwood floors, and other hard surfaces.

The physical form of the protomicroemulsion herein is typically a liquid, gel, paste, or even a solid and may itself be aqueous or non-aqueous. Other forms are also useful herein, as long as the protomicroemulsion may be diluted with water to form the desired microemulsion. Furthermore, the protomicroemulsion herein may be provided as a separate product, or in conjunction with an applicator, for example, a dispensing container, a cleaning implement, and/or a wiping or scrubbing substrate. Preferred dispensing containers are known in the art, and will typically comprise a hand-held bottle having an aesthetically desirable and/or ergonomic shape, and a dispensing spout, trigger sprayer, or spray nozzle.

Preferred foam-generating dispensers useful herein include those discussed in US 2004/0254253 A1 wherein the foam-generating dispenser generates a foam having a foam to weight ratio of greater than about 2 mL/g.: T8900, OpAd FO, 8203, and 7512 series foamers from Afa-Polytek, Helmond, The Netherlands; T1, F2, and WR-F3 series foamers from Airspray International, Inc., Alkmaar, The Netherlands or North Pompano Beach, Fla., U.S.A.; TS-800 and Mixor series foamers from Saint-Gobain Calmar, Inc., City of Industry, Calif., U.S.A.; pump foamers and squeeze foamers from Daiwa Can Company, Tokyo, Japan; TS1 and TS2 series foamers from Guala Dispensing USA, Inc., Hillsborough, N.J., U.S.A.; and YT-87L-FP, YT-87L-FX, and YT-97 series foamers from Yoshino Kogyosho Co., Ltd., Tokyo, Japan. Also see the foam-generating dispensers discussed in the Japanese-language publications *Food & Package*, (2001) vol. 42, no. 10, pp 609-13; *Food & Package*, (2001) vol. 42, no. 11, pp 676-79; and *Food & Package*, (2001) vol. 42, no. 12, pp 732-35. Variations and modifications of existing foam-generating dispensers are especially useful herein, especially by modifying air piston:product piston volume ratio, mesh/net sizes, impinging angle, etc., as well as optimization of the sizes and dimensions of the cylinder, rod, dip tube, nozzle, etc.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A microemulsion or protomicroemulsion composition comprising:

a) a solvent system comprising from about 3 wt % to about 6 wt % of permethyl of the formula:

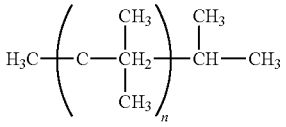

wherein n is from 3 to 5, and from about 3 wt % to about 6 wt % 1-phenoxy-2-propanol;

b) at least about 25%, by weight of the composition, of one or more surfactants selected from the group consisting of anionic, nonionic, cationic, and ampholytic surfactants; and c) water.

2. The microemulsion or protomicroemulsion composition of claim 1, wherein the one or more surfactants comprises a disrupting surfactant.

3. The microemulsion or protomicroemulsion composition of claim 1, wherein the one or more surfactants are selected from the group consisting of alkyl ethoxylated sulfate surfactants, amine oxides and mixtures thereof.

4. The microemulsion or protomicroemulsion composition of claim 1 wherein the one or more surfactants are selected from the group consisting of alkyl ethoxylated sulfate surfactants, amine oxides, and

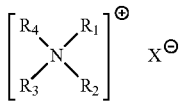

wherein $R_1$ and $R_2$ are individually selected from the group consisting of $C_1$-$C_4$ linear alkyl moieties; X is a water soluble anion; and (1) $R_3$ and $R_4$ are each a $C_6$-$C_{14}$ alkyl moiety.

5. The microemulsion or protomicroemulsion composition of claim 1, wherein the one or more surfactants are selected from the group consisting of alkyl ethoxylated sulfate surfactants, amine oxides, and

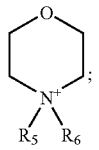

wherein $R_5$ is selected from a $C_{12}$-$C_{18}$ linear alkyl moiety and $R_6$ is selected from a $C_1$-$C_4$ linear alkyl moiety.

6. The microemulsion or protomicroemulsion composition of claim 1, wherein the composition is contained within a container comprising a foam-generating dispenser.

7. A microemulsion or protomicroemulsion composition comprising:

a) a solvent system comprising permethyl of the formula:

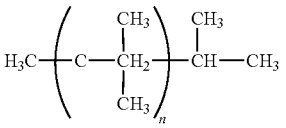

wherein n is from 3 to 5, and 1-phenoxy-2-propanol, wherein the permethyl and 1-phenoxy-2-propanol are present in a 1:3 to 3:1 ratio;

b) at least about 25%, by weight of the composition, of one or more surfactants selected from the group consisting of anionic, nonionic, cationic, and ampholytic surfactants; and c) water.

8. The microemulsion or protomicroemulsion composition of claim 1, wherein the solvent system comprises a Hansen, parameter comprising a δd of from 15 to about 18; δp from 0 to about 8 and δH of from 0 to about 12;

wherein the resulting Hansen parameter of the solvent system comprises a δd of from 15 to about 18; δp from about 2 to about 8 and δH of from about 5 to about 12.

9. The microemulsion or protomicroemulsion composition of claim 7, wherein the composition is contained within a container comprising a foam-generating dispenser.

* * * * *